US009899139B2

(12) United States Patent
Li et al.

(10) Patent No.: US 9,899,139 B2
(45) Date of Patent: Feb. 20, 2018

(54) MAGNETIC COMPONENT

(71) Applicants: LITE-ON ELECTRONICS (GUANGZHOU) LIMITED, Guangzhou (CN); LITE-ON TECHNOLOGY CORPORATION, Taipei (TW)

(72) Inventors: Tsai-Chung Li, New Taipei (TW); Wen-Pin Liao, Taoyuan County (TW); Chou-Ting Cheng, New Taipei (TW); Hong-Chih Lee, Taoyuan County (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 41 days.

(21) Appl. No.: 14/822,143

(22) Filed: Aug. 10, 2015

(65) Prior Publication Data

US 2016/0336111 A1 Nov. 17, 2016

(30) Foreign Application Priority Data

May 12, 2015 (CN) ..... 2015 1 0240481

(51) Int. Cl.
*H01F 5/04* (2006.01)
*H01F 27/28* (2006.01)

(52) U.S. Cl.
CPC ..... *H01F 27/2828* (2013.01); *H01F 5/04* (2013.01); *H01F 2005/043* (2013.01)

(58) Field of Classification Search
CPC .. H01F 27/325; H01F 27/29; H01F 2005/043; H01F 5/04
See application file for complete search history.

(56) References Cited

U.S. PATENT DOCUMENTS 4,490,004 A * 12/1984 Lawrence ..... H01F 5/04 439/389
4,916,424 A * 4/1990 Kijima ..... H01F 27/325 336/192
5,315,280 A * 5/1994 Stokes ..... H01F 5/02 336/192
6,734,777 B2 * 5/2004 Yeh ..... H01F 27/324 336/198
9,183,974 B1 * 11/2015 Folker ..... H01F 5/02
(Continued)

*Primary Examiner* — Elvin G Enad
*Assistant Examiner* — Malcolm Barnes
(74) *Attorney, Agent, or Firm* — Li & Cai Intellectual Property (USA) Office

(57) ABSTRACT

The present invention discloses a magnetic component and which includes a bobbin, a magnetic core assembly, a first winding, and a second winding. The bobbin has a main body, a channel, and a pin holder. The main body has a primary winding section and a secondary winding section. The channel penetrates the main body. The pin holder is extended from a side of the main body. The magnetic core assembly is partially disposed in the channel of the bobbin. The first winding and the second winding respectively have two outlet terminals. The first winding is wound around the primary winding section. The second winding is wound around the secondary winding section. Two outlet terminals of the first winding and two outlet terminals of the second winding are configured in the pin holder.

16 Claims, 9 Drawing Sheets

(56) References Cited

U.S. PATENT DOCUMENTS

| | | | | |
|---|---|---|---|---|
| 9,236,777 | B2 * | 1/2016 | Hanson | H02K 3/28 |
| 9,362,044 | B1 * | 6/2016 | Folker | H01F 5/04 |
| 2002/0017975 | A1 * | 2/2002 | Chiang | H01F 5/02 336/198 |
| 2004/0183642 | A1 * | 9/2004 | Suzui | H01F 27/292 336/192 |
| 2007/0285203 | A1 * | 12/2007 | Ger | H01F 27/325 336/208 |
| 2009/0278646 | A1 * | 11/2009 | Chen | H01F 27/325 336/177 |
| 2009/0295530 | A1 * | 12/2009 | Faccin | H01F 27/325 336/220 |
| 2010/0013590 | A1 * | 1/2010 | Chen | H01F 27/326 336/65 |
| 2010/0225432 | A1 * | 9/2010 | Zhai | H01F 27/027 336/192 |
| 2011/0043315 | A1 * | 2/2011 | Kobayashi | H01F 27/29 336/192 |
| 2012/0106207 | A1 * | 5/2012 | Tsai | H01F 27/324 336/192 |
| 2013/0169400 | A1 * | 7/2013 | Kim | H01F 27/2823 336/192 |

* cited by examiner

MAGNETIC COMPONENT

BACKGROUND

1. Technical Field

The present disclosure relates to a magnetic component, in particular, to a magnetic component having a primary winding and a secondary winding, wherein the outlet terminals of the primary winding and those of the secondary winding are positioned at a same side.

2. Description of Related Art

Magnetic components are a necessary component in operating electrical equipment. Conventional electronic devices usually include many magnetic components, such as transformers. A transformer is a magnetic component capable of Electro-Magnetic Energy Conversion for adjusting the voltage into a suitable range.

When the electronic device wants to output the higher power, it needs many magnetic components connected in parallel and the secondary winding needs to adopt the divided winding, so that the outlet terminal of the electronic device outputs the needed current density. Because of the limitation of product process and height of the magnetic components, the magnetic components occupy bigger area in the circuit board. Besides, the primary side and the secondary side are separated by a partition plate of the magnetic component, to meet safety requirements, e.g., when the magnetic component is in high altitude above 5,000 meters, there is an official regulatory distance that must be kept between the primary side and the secondary side. However, the partition plate may cause a constant leakage inductance. The more the partition plate causes leakage inductance, the more the electronic device has power loss. Conversely, the less the partition plate causes leakage inductance, the less the electronic device has power loss. In order to decrease the leakage inductance caused by the partition plate for enhancing the conversion efficiency of the magnetic component, the winding of the magnetic component usually adopts the thicker thread diameter or winds around the corresponding winding section by a parallel wound method. Besides, the conventional magnetic component needs to increase the solder temperature in the manufacturing process, to ensure the yield rate of the solder. The windings of the magnetic component need to have a tube or insulating tape, to ensure the quality of the magnetic component.

SUMMARY

Accordingly, an objective of the instant disclosure is to provide a magnetic component, which can decrease the volume of the whole magnetic component without influencing conversion efficiency. The magnetic component does not suffer from the limitation of product process and height, and the output terminal of the electrical equipment can output the needed current density.

An exemplary embodiment of the instant disclosure provides a magnetic component. The magnetic component includes a bobbin, a magnetic core assembly, a first winding, and a second winding. The bobbin has a main body, a channel, and a pin holder. The main body has a primary winding section and a secondary winding section. The channel is configured for penetrating the main body. The pin holder is configured for being extended from a side of the main body. The magnetic core assembly is partially disposed in the channel. The first winding and the second winding have two outlet terminals. The first winding is configured for being wound around the primary winding section. The second winding is configured for being wound around the secondary winding section. Two outlet terminals of the first winding and two outlet terminals of the second winding are configured in the pin holder.

Another exemplary embodiment of the instant disclosure provides a magnetic component. The magnetic component includes a bobbin, a magnetic core assembly, a first winding, and a second winding. The bobbin has a main body, a channel, a first pin holder, and a second pin holder. The main body has a primary winding section and a secondary winding section. The channel is configured for penetrating the main body. The first pin holder is configured for being extended from a side of the main body. The second pin holder is configured for being extended from another side of the main body. The magnetic core assembly is partially disposed in the channel. The first winding and the second winding have two outlet terminals. The first winding is configured for being wound around the primary winding section. The second winding is configured for being wound around the secondary winding section. One of the two outlet terminals of the first winding are configured in the first pin holder, and the other of the two outlet terminals of the first winding are configured in the second pin holder; or the two outlet terminals of the first winding are configured in the first pin holder. The two outlet terminals of the second winding are configured in the first pin holder. Therefore, at least one outlet terminal of the first winding and two outlet terminals of the second winding are positioned at a same side.

In order to further understand the techniques, means and effects of the present disclosure, the following detailed descriptions and appended drawings are hereby referred to, such that, and through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1A:
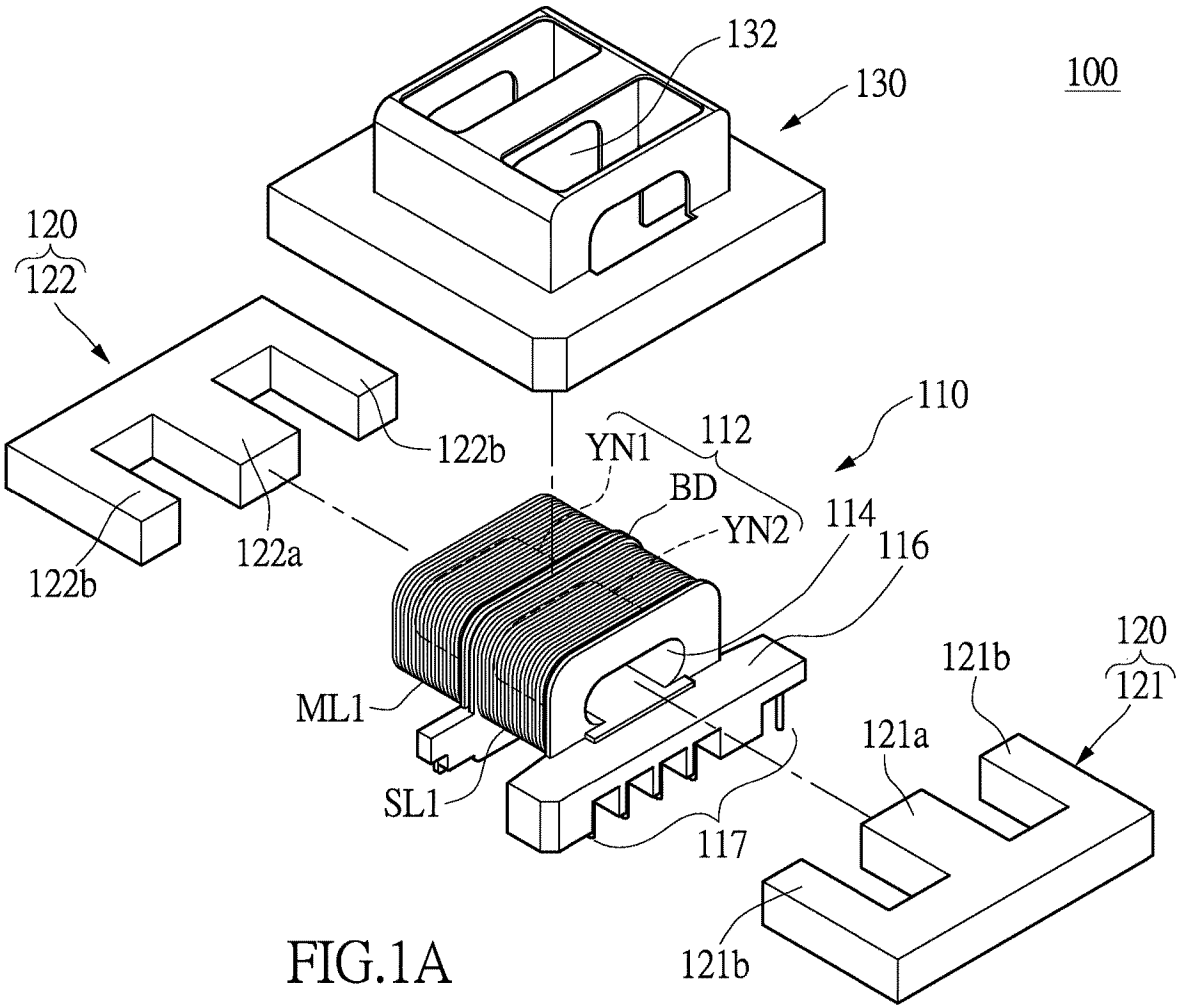
FIG. 1A shows an exploded view of a magnetic component according to an exemplary embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or like parts.

This embodiment provides a magnetic component having a primary winding and a secondary winding. At least one outlet terminal of the primary winding and at least one outlet terminal of the secondary winding are positioned at a same side. When the electronic device with the magnetic component wants to output the higher power, the secondary winding is laterally added in the magnetic component. Compared with the conventional magnetic component, the magnetic component of the present disclosure does not suffer from the limitation of product process and height, to achieve the needed current density outputted from the outlet terminal of the electronic device. The magnetic component provided in the exemplary embodiment of the present disclosure is described in the following paragraphs.

Figure 1B:
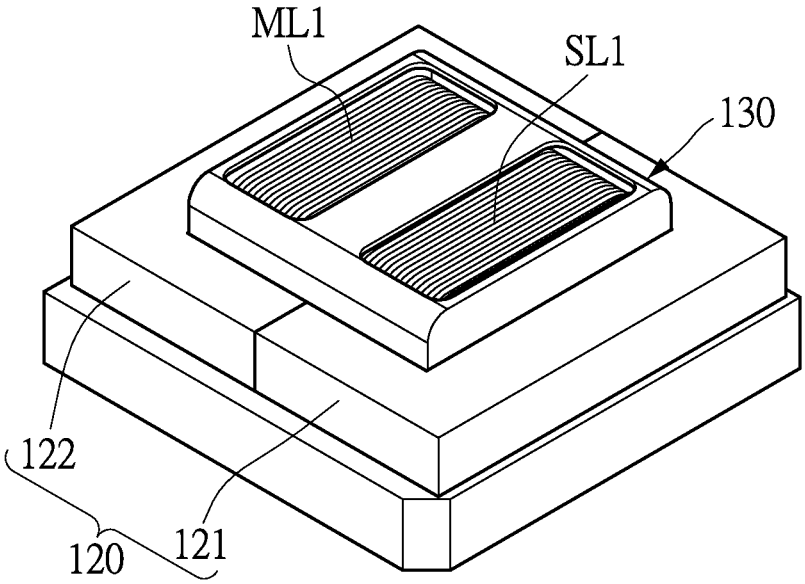
FIG. 1B shows an assembled view of a magnetic component according to an exemplary embodiment of the present disclosure.

Firstly, please refer to FIGS. 1A and 1B, which show an exploded view and an assembled view of a magnetic component according to an exemplary embodiment of the present disclosure. As shown in FIG. 1A, the magnetic component 100 is configured in the electrical equipment (e.g., the power supply), and uses Electro-Magnetic Energy Conversion for adjusting the voltage into a suitable range. The magnetic component 100 includes a bobbin 110, a magnetic core assembly 120, a housing 130, a first winding ML1, and a second winding SL1. The bobbin 110 has a main body 112, a channel 114, and a pin holder 116.

The channel 114 penetrates the main body 112. In the present disclosure, the main body 112 is a bar-shaped structure. The pin holder 116 is extended from a side of the main body 112, and has a plurality of pins 117 electrically connecting to the circuit board (not shown in FIGs), the first winding ML1, and the second winding SL1. In the present disclosure, the pin holder 116 is extended from the right-side of the main body 112. The pin holder 116 can be extended from the left-side of the main body 112, and the present disclosure is not limited thereto.

The magnetic core assembly 120 is partially disposed in the channel 114. More specifically, the magnetic core assembly 120 is an EE-type, which includes a first magnetic core portion 121 and the second magnetic core portion 122. The first magnetic core portion 121 has an axle center 121*a* and two side pillars 121*b*. The second magnetic core portion 122 has an axle center 122*a* and two side pillars 122*b*. The axle center 121*a* of the first magnetic core portion 121 and the axle center 122*a* of the second magnetic core portion 122 penetrate the channel 114 of the main body 112. Two side pillars 121*b* and two side pillars 122*b* are respective configured to two sides of the main body 112 of the bobbin 110. In the present disclosure, the magnetic core assembly 120 can also be UI-type, UU-type, EI-type, EER-type, EFD-type, or EED-type, and the present disclosure is not limited thereto. The housing 130 and the bobbin 110 are assembled with each other. The housing 130 has a hollow portion 132. The bobbin 110 and the axle centers 121*a* and 122*a* of the magnetic core assembly 120 are disposed in the hollow portion 132, to avoid the Magnetic Energy Conversion between the magnetic core assembly 120 and the bobbin 110 configured in the hollow portion 132 suffering from external disturbance. The housing 130 can be disposed according to the actual architecture of the magnetic component 100, and is not limited to the examples provided by the exemplary embodiment.

The main body 112 has a plurality of winding sections, and the first winding ML1 and the second winding SL1 are respectively wound around the winding sections. The condition of the first winding ML1 and the second winding SL1 wound around the winding sections of the main body 112 will be described in the following paragraph.

Figure 1C:
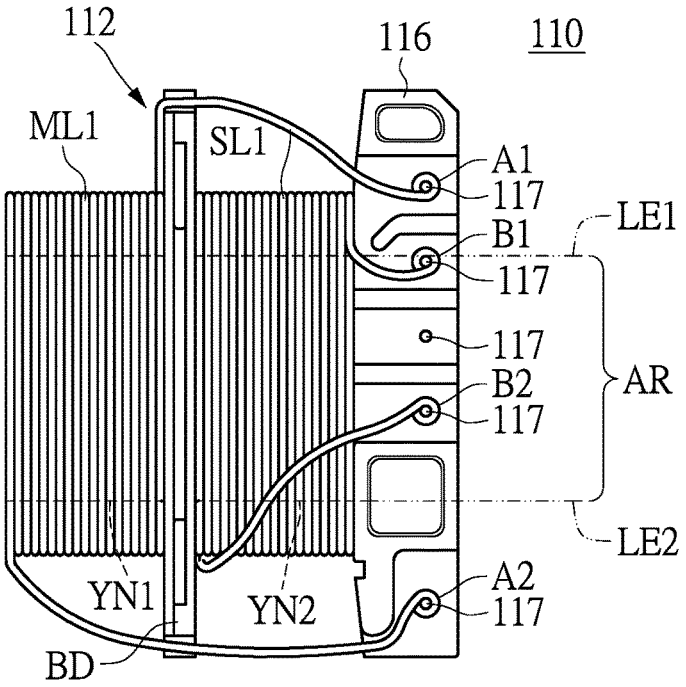
FIG. 1C shows a bottom-side view of a bobbin according to an exemplary embodiment of the present disclosure.

Please refer to FIG. 1C, which shows a bottom-side view of a bobbin according to an exemplary embodiment of the present disclosure. As shown in FIG. 1C, the main body 112 has a primary winding section YN1 and a secondary winding section YN2. The outer diameter of the primary winding section YN1 and the outer diameter of the secondary winding section YN2 are equivalent. The first winding ML1 is wound around the primary winding section YN1 far from the pin holder 116, and has two outlet terminals A1 and A2. The second winding SL1 is wound around the secondary winding section YN2 near to the pin holder 116, and has two outlet terminals B1 and B2. It is worth to note that two outlet terminals A1 and A2 of the first winding ML1 and two outlet terminals B1 and B2 of the second winding SL1 are respectively configured in one of the pins 117 of the pin holder 116, so that the outlet terminals A1 and A2 of the first winding ML1 and the outlet terminals B1 and B2 of the second winding SL1 are positioned at a same side. More specifically, the secondary winding section YN2 extends to an area AR on the pin holder 116. The area AR is defined by lines LE1 and LE2 extending from the outer boundary of the secondary winding section YN2 of the bobbin 110. Two outlet terminals A1 and A2 of the first winding ML1 are coupled to two of the pins 117 disposed outside the area AR, and two outlet terminals B1 and B2 of the second winding SL1 are coupled to two of the pins 117 disposed inside the area AR, Accordingly, the housing 130 covers the bobbin 110, the part of the magnetic core assembly 120, the part of the first winding ML1, and the part of the second winding SL1, to become the magnetic component 100, as shown in FIG. 1B. In the present disclosure, the primary winding section YN1 indicates the primary side winding section of the magnetic component 100. The secondary winding section YN2 indicates the secondary side winding section of the magnetic component 100. The primary winding section YN1 can be configured near to the position of the pin holder 116, and the secondary winding section YN2 can be configured far from the position of the pin holder 116, and the present disclosure is not limited thereto.

Figure 1D:
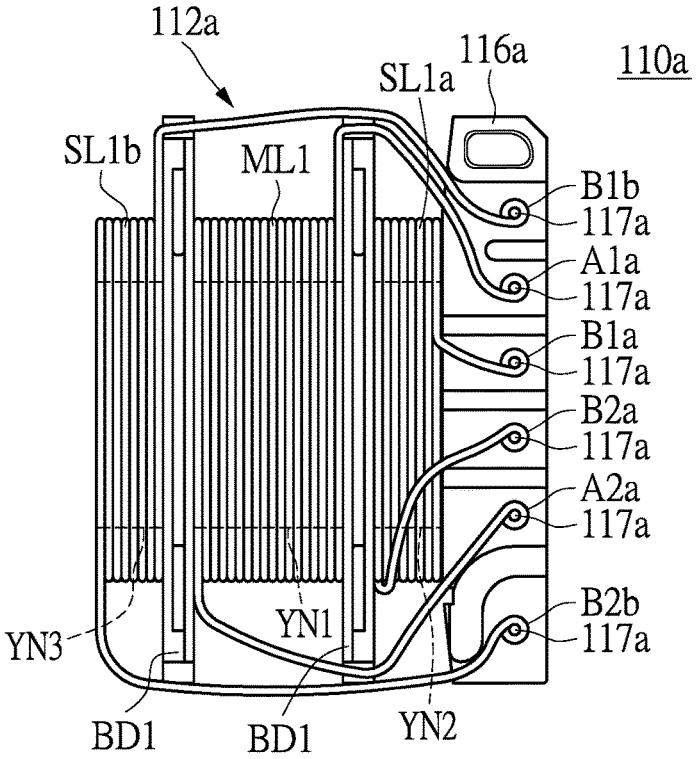
FIG. 1D shows a bottom-side view of a bobbin according to another exemplary embodiment of the present disclosure.

In other disclosures, the magnetic component 100 further includes a third winding. The first winding, the second winding, and the third winding are alternately configured in the corresponding winding section. As shown in FIG. 1D, the main body 112*a* of the bobbin 110*a* has one primary winding section YN1 and two secondary winding sections YN2 and YN3. The secondary winding section YN2, the primary winding section YN1, and the secondary winding section YN3 are arranged in series starting from the pin holder 116*a*, i.e., the secondary winding section YN2 is arranged at a side of the primary winding section YN1 and the secondary winding section YN3 is arranged at another side of the primary winding section YN1. The first winding ML1, the second winding SL1*a*, and the third winding SL1*b* are respectively wound around the primary winding section YN1, and the secondary winding sections YN2 and YN3, so that the second winding SL1*a*, the first winding ML1, and the third winding SL1*b* are arranged in series starting from the main body 112*a*. The first winding ML1 has two terminals A1*a* and A2*a*, the second winding SL1*a* has two terminals B1*a* and B2*a*, and the third winding SL1*b* has two terminals B1*b* and B2*b*. It is worth to note that the outlet terminals A1*a*, A2*a* of the first winding ML1, the outlet terminals B1*a*, B2*a* of the second winding SL1*a*, and the outlet terminals B2*a*, B2*b* of the third winding SL1*b* are respectively configured in one of the pins 117*a* of the pin holder 116*a*, so that the outlet terminals A1*a*, A2*a*, and the outlet terminals B1*a*, B2*a*, B1*b*, B2*b* of the second and third windings SL1*a* and SL1*b* are positioned at a same side.

The order of the winding sections configured in the main body can be changed. For example, the primary winding section YN1, the secondary winding section YN2, and the secondary winding section YN3 are arranged in series starting from the pin holder, i.e., the primary winding section YN1 is arranged at a side of the secondary winding section YN2, and the secondary winding section YN3 is arranged at another side of the secondary winding section YN2. The present disclosure is not limited thereto. Besides, the winding section of the third winding SL1*b* can be changed to primary winding section (not shown in FIGs), so that the main body 112 of the bobbin 110*a* has two primary winding sections and one secondary winding section. Similarly, the number of the primary winding section and the secondary winding section can be changed. The present disclosure is not limited thereto.

In the following disclosure, a primary winding is taken as example of the first winding and a secondary winding is taken as example of the second winding. When the electrical equipment wants to output the higher power, the secondary winding section can be laterally added in the main bodies 112 and 112*a*, and the second winding is wound around the added secondary winding section, i.e., the secondary winding is laterally added, to increase Electro-Magnetic Energy Conversion and to achieve the needed current density outputted from the outlet terminal of the electronic device.

Please refer to FIGS. 1A, 1C, and 1D. The main body further has at least one partition plate configured in the common border between any adjacent winding sections, to separate the primary winding and the secondary winding and to meet safety requirements. As shown in FIG. 1C, the common border between the primary winding section YN1 and the secondary winding section YN2 of the main body 112 configures a partition plate BD, to separate the first winding ML1 (the primary side) and the second winding SL1 (the secondary side). As shown in FIG. 1D, the common borders among the primary winding section YN1, the secondary winding sections YN2, YN3 of the main body 112*a* respectively configures partition plates BD1, to separate the second winding SL1*a* (the secondary side), the first winding ML1 (the primary side), and the third winding SL1*b* (the secondary side).

Figure 1E:
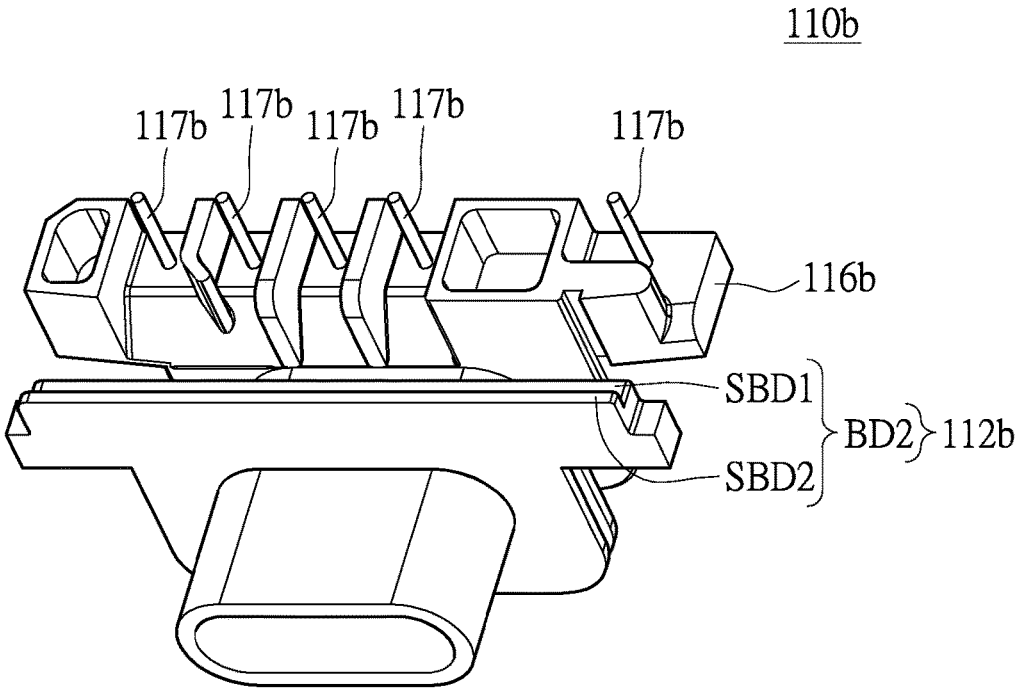
FIG. 1E shows a bottom-side view of a bobbin according to another exemplary embodiment of the present disclosure.

Next, please refer to FIG. 1E, which shows a bottom-side view of a bobbin according to another exemplary embodiment of the present disclosure. In the bobbin 110*b* shown in FIG. 1E, the partition plate BD2 of the main body 112*b* is different from the partition plate BD shown in FIGS. 1A-1B and the partition plates BD1 shown in FIG. 1C. The difference is that the partition plate BD2 has a first sub-partition plate SBD1 and a second sub-partition plate SBD2. The height of the first sub-partition plate SBD1 is higher than the height of the second sub-partition plate SBD2 and the first sub-partition plate SBD1 and the second sub-partition plate SBD2 are configured with each other, to form a ladder structure. This means that there is a drop height between the first sub-partition plate SBD1 and the second sub-partition plate SBD2. With respect to structures and connection relationships of the pin holder 116*b*, the pins 117*b*, the first winding ML1, and the second winding SL1 are the same as that of the pin holder 116, the pins 117, the first winding ML1, and the second winding SL1 shown in FIG. 1C, so detailed description is omitted.

Therefore, there is ladder structure formed between the first sub-partition plate SBD1 and the second sub-partition plate SBD2, so that the Creepage Distance between the first winding ML1 (the primary side) and the second winding SL1 (the secondary side) is increased. Accordingly, the bobbin 110*b* meets the higher safety requirement using the same thickness of the partition plate BD2. Besides, when the electrical equipment wants to output higher power in the same layout area, it needs to decrease the power loss. At present, when electrical equipment has to operate in high altitude above 5,000 meters and simultaneously meet safety requirements, the distance between the partition plates needs to be increased, to achieve the official regulatory distance that must be kept between the primary and the secondary side. The aforementioned method may raise leakage inductance and then increases the power loss of the transformers, to increase the needed layout area. Therefore, under the ladder structure between the first sub-partition plate SBD1 and the second sub-partition plate SBD2, when the thickness of the partition plate BD2 of the bobbin 110*b* is decreased, the bobbin 110*b* can still meet the higher safety requirement for high-power electrical equipment configured in the high altitude above 5,000 meters.

Figure 2A:
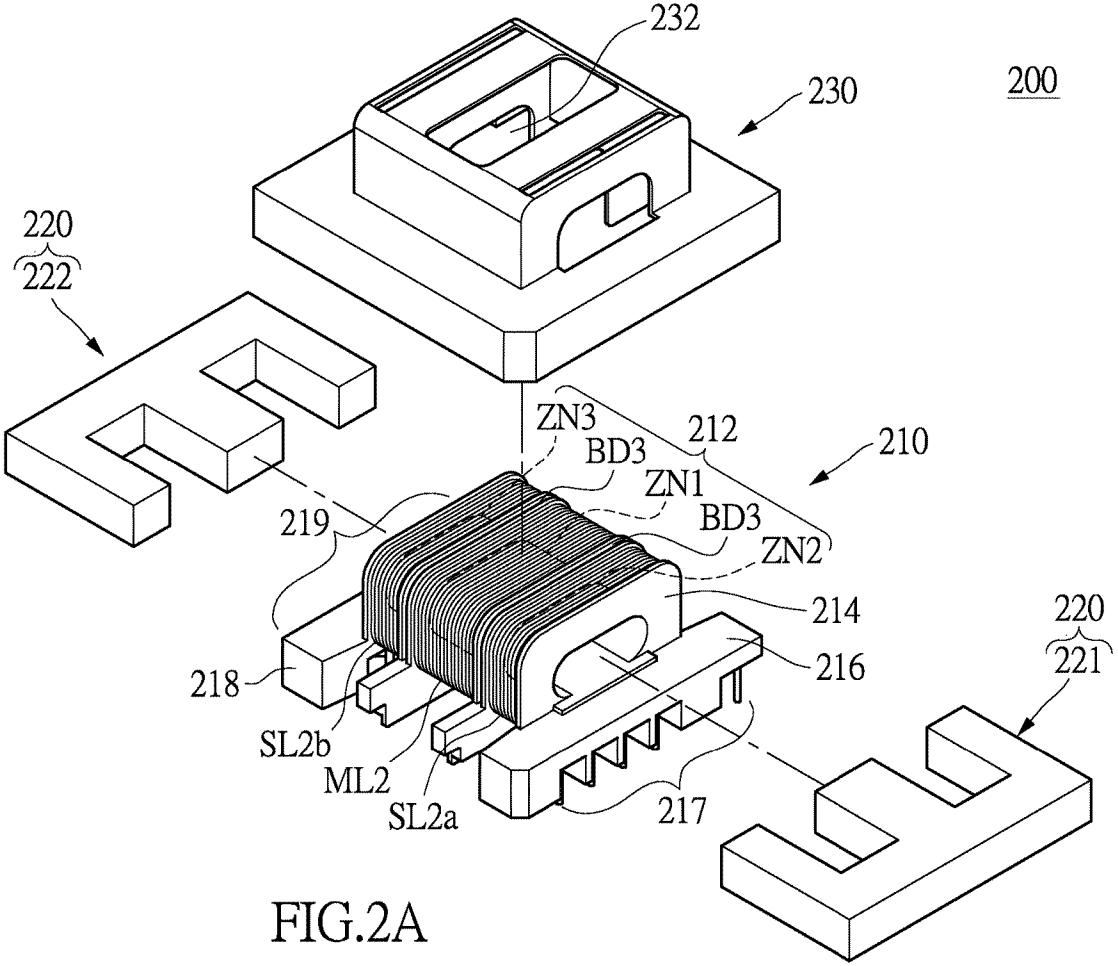
FIG. 2A shows an exploded view of a magnetic component according to another exemplary embodiment of the present disclosure.
Figure 2B:
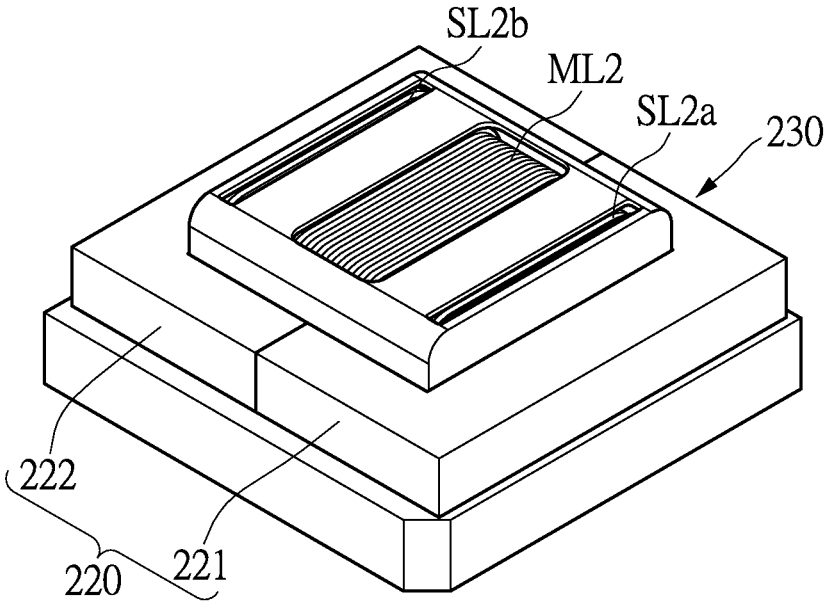
FIG. 2B shows an assembled view of a magnetic component according to another exemplary embodiment of the present disclosure.

Next, please refer to FIGS. 2A and 2B, which show an exploded view and an assembled view of a magnetic component according to another exemplary embodiment of the present disclosure. As shown in FIG. 2A, the magnetic component 200 is configured in the electrical equipment (e.g., the power supply), and uses Electro-Magnetic Energy Conversion for adjusting the voltage into a suitable range. The magnetic component 200 includes a bobbin 210, a magnetic core assembly 220, a housing 230, a first winding ML2, a second winding SL2*a*, and a third winding SL2*b*. The bobbin 210 has a main body 212, a channel 214, a first pin holder 216, and a second pin holder 218. The magnetic core assembly 220 has a first magnetic core portion 221 and a second magnetic core portion 222. The housing 230 has a hollow portion 232.

The difference between the magnetic component 200 and the magnetic component 100 is that the first pin holder 216 is extended from the right side of the main body 212 and the second pin holder 218 is extended from the left side of the main body 212. The main body 212 has a plurality of winding sections. The first winding ML2, the second winding SL2*a*, and the third winding SL2*b* are respectively wound around the winding sections. The condition of the first winding ML2, the second winding SL2*a*, and the third winding SL2*b* wound around the winding sections of the main body 212 will be described in the following paragraphs.

Figure 2C:
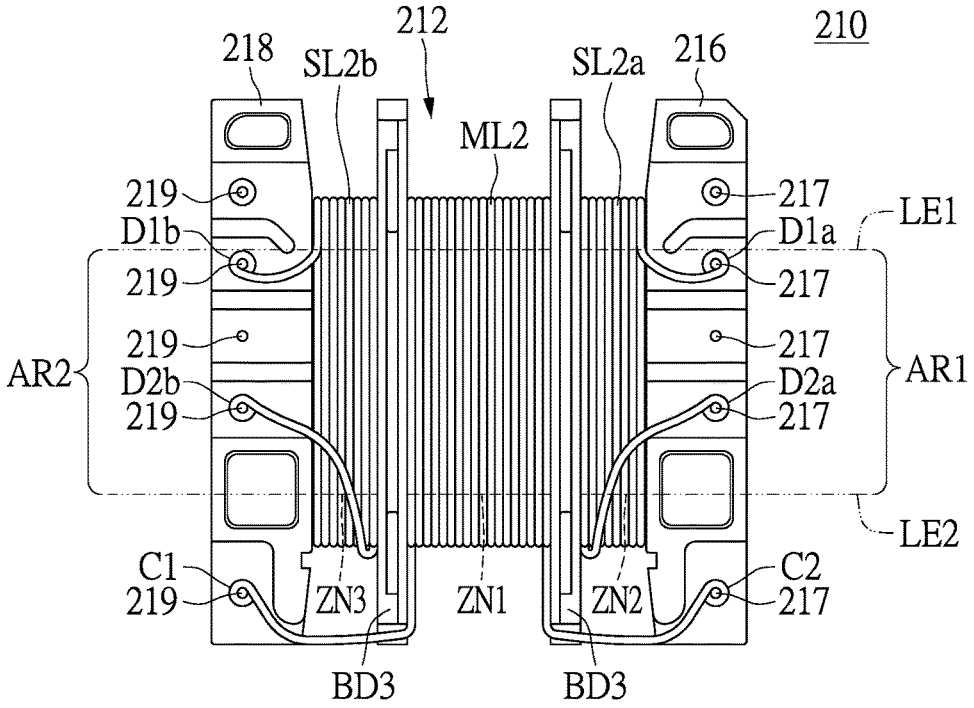
FIG. 2C shows a bottom-side view of a bobbin according to another exemplary embodiment of the present disclosure.

Please refer to FIG. 2C, which shows a bottom-side view of a bobbin according to another exemplary embodiment of the present disclosure. According to the bobbin 210 shown in FIG. 2C, the main body 212 has one primary winding section ZN1 and two secondary winding sections ZN2, ZN3. The second winding SL2*a* is wound around the secondary winding section ZN2 near to the first pin holder 216, and has two outlet terminals D1*a*, D2*a*. The third winding SL2*b* is wound around the secondary winding section ZN3 near to the second pin holder 218, and has two outlet terminals D1*b*, D2*b*. The first winding ML2 is wound around the primary winding section ZN1 between the second winding SL2*a* and the third winding SL2*b*, and has two outlet terminals C1, C2.

It is worth to note that the outlet terminal C2 of the first winding ML2 and the two outlet terminals D1*a*, D2*a* of the second winding SL2*a* are respectively configured in one of the pins 217 of the first pin holder 216, so that the outlet terminal C2 of the first winding ML2 and the outlet terminals D1*a*, D2*a* of the second winding SL2*a* are positioned at a same side. Besides, the outlet terminal C1 of the first winding ML2 and the two outlet terminals D1*b*, D2*b* of the third winding SL2*b* are respectively configured in one of the pins 219 of the second pin holder 218, so that the outlet terminal C1 of the first winding ML2 and the outlet terminals D1*b*, D2*b* of the third winding SL2*b* are positioned at a same side. The outer diameter of the primary winding section ZN1 and the outer diameter of the secondary winding sections ZN2 and ZN3 are equivalent. More specifically, the secondary winding section ZN2 extends to a first area AR1 on the first pin holder 216 and extends to a second area AR2 on the second pin holder 218. The first area AR1 is defined by lines LE1 and LE2 extending from the outer boundary of the secondary winding section ZN2 of the bobbin 210. The second area AR2 is defined by the lines LE1 and LE2 extending from the outer boundary of the secondary winding section ZN3. One of the two outlet terminals C2 of the first winding ML2 is coupled to one pin 217 of the first pin holder 216 disposed outside the first area AR1. The other of the two outlet terminals C1 of the first winding ML2 is coupled to one pin 219 of the second pin holder 218 disposed outside the second area AR2. Two outlet terminals D1*a* and D2*a* of the second winding SL2*a* are coupled to two pins 217 of the first pin holder 216 disposed inside the first area AR1. Two outlet terminals D1*b* and D2*b* of the second winding SL2*b* are coupled to two pins 219 of the second pin holder 218 disposed inside the second area AR2, Accordingly, the housing 230 covers the bobbin 210, the part of the magnetic core assembly 220, the part of the first winding ML2, the part of the second winding SL2*a*, and the part of the third winding SL2*b*, to become the magnetic component 200, as shown in FIG. 2B.

Figure 2D:
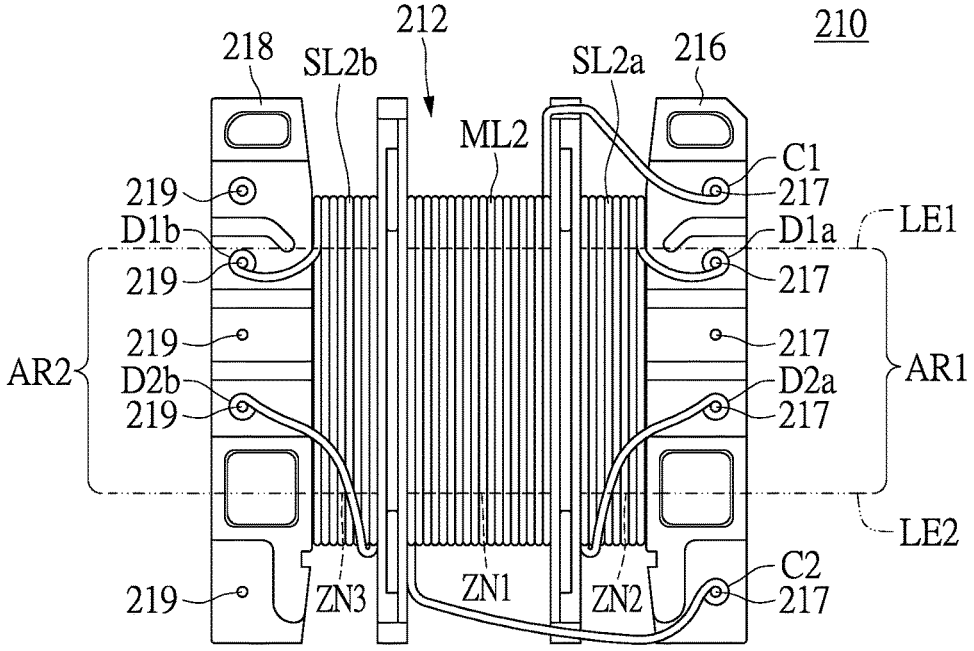
FIG. 2D shows a bottom-side view of a bobbin according to another exemplary embodiment of the present disclosure.

In another disclosure, two outlet terminals C1, C2 of the first winding ML1 can be respectively configured in one of the pins of the same pin holder. Please refer to FIG. 2D, the outlet terminal C1 of the first winding ML2 is configured in one of the pins 217 of the first pin holder 216, so that the outlet terminals C1, C2 of the first winding ML2 and the outlet terminals D1*a*, D2*a* of the second winding SL2*a* are positioned at a same side. The outlet terminals D1*b*, D2*b* of the third winding SL2*b* are respectively configured in one of the pins 219 of the second pin holder 218, so that the outlet terminals D1*b*, D2*b* of the third winding ML2*b* and the outlet terminals C1, C2 of the first winding ML2 are positioned at a different side. The outer diameter of the primary winding section ZN1 and the outer diameter of the secondary winding sections ZN2 and ZN3 are equivalent. More specifically, the two outlet terminals C1 and C2 of the first winding ML2 are coupled to two pins 217 of the first pin holder 216 disposed outside the first area AR1. Two outlet terminals D1*a* and D2*a* of the second winding SL2*a* are coupled to two pins 217 of the first pin holder 216 disposed inside the first area AR1. Two outlet terminals D1*b* and D2*b* of the second winding SL2*b* are coupled to two pins 219 of the second pin holder 218 disposed inside the second area AR2.

Figure 2E:
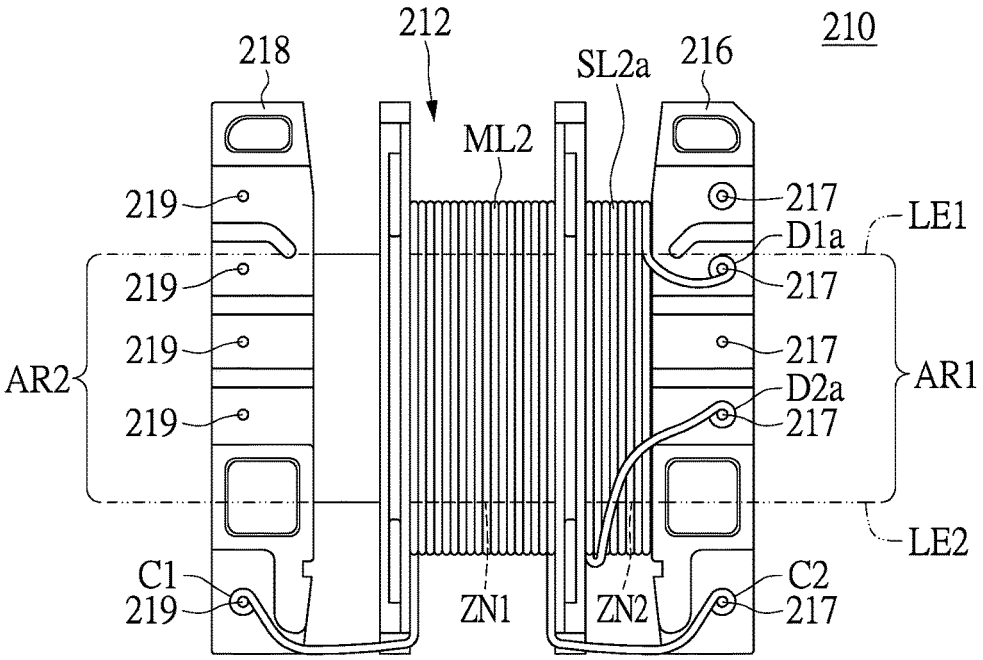
FIG. 2E shows a bottom-side view of a bobbin according to another exemplary embodiment of the present disclosure.

In another disclosure, in the main body 212 of the bobbin 210, the third winding SL2*b* can be omitted, and the first winding ML2 and the second winding SL2*a* remain. As shown in FIG. 2E, the outlet terminal C2 of the first winding ML2 and the outlet terminals D1*a*, D2*a* of the second winding SL2*a* are respectively configured in one of the pins 217 of the first pin holder 216, so that the outlet terminal C2 of the first winding ML2 and the outlet terminals D1*a*, D2*a* of the second winding SL2*a* are positioned at a same side. Besides, the outlet terminal C1 of the first winding ML2 is configured in one of the pins 219 of the second pin holder 218, so that the outlet terminal C1 of the first winding ML2, the outlet terminal C2 of the first winding ML2, and the outlet terminals D1*a*, D2*a* of the second winding SL2*a* are positioned at a different side. The outer diameter of the primary winding section ZN1 and the outer diameter of the secondary winding section ZN2 are equivalent. More specifically, one of the two outlet terminals C2 of the first winding ML2 is coupled to one pin 217 of the first pin holder 216 disposed outside the first area AR1, and the other of the two outlet terminals C1 of the first winding ML2 is coupled to one pin 219 of the second pin holder 218 disposed outside the second area AR2. Two outlet terminals D1*a* and D2*a* of the second winding SL2*a* are coupled to two pins 217 of the first pin holder 216 disposed inside the first area. AR1.

Figure 2F:
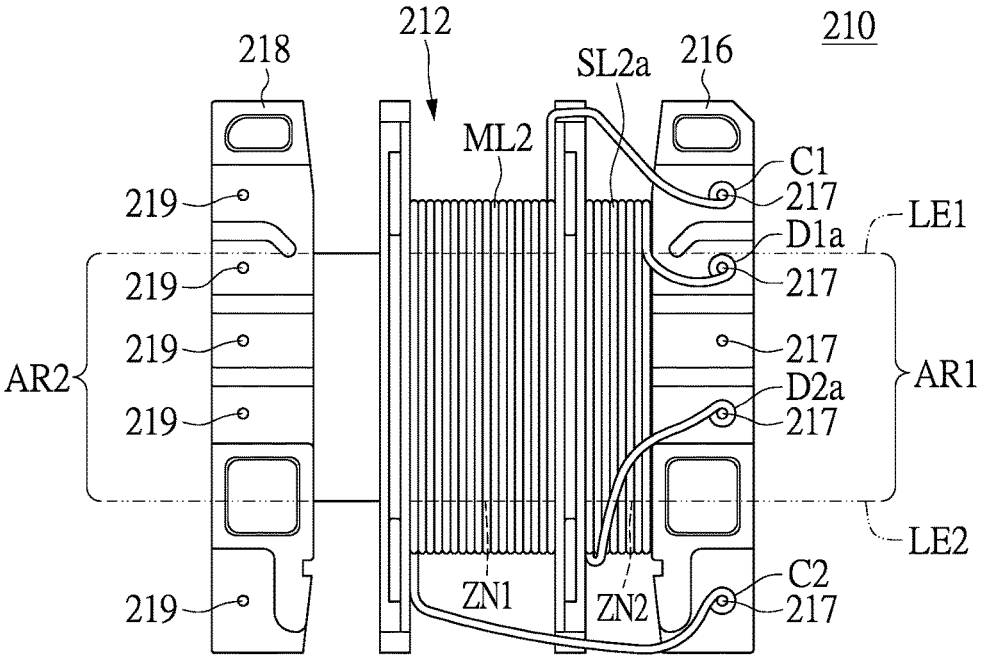
FIG. 2F shows a bottom-side view of a bobbin according to another exemplary embodiment of the present disclosure.

Certainly, two outlet terminals C1, C2 of the first winding ML2 can be configured in one of the pins of the pin holder configuring two outlet terminals D1*a* and D2*a* of the second winding SL2*a*. As shown in FIG. 2F, the outlet terminal C1 of the first winding ML2 is configured in one of the pins 217 of the first pin holder 216, so that the outlet terminals C1, C2 of the first winding ML2 and the outlet terminals D1*a*, D2*a* of the second winding SL2*a* are positioned at a same side. The pins 219 of the second pin holder 218 are not wound around the outlet terminals of the first winding and the second winding. The outer diameter of the primary winding section ZN1 and the outer diameter of the secondary winding section ZN2 are equivalent. More specifically, the two outlet terminals C1 and C2 of the first winding ML2 is coupled to two pins 217 of the first pin holder 216 disposed outside the first area AR1. Two outlet terminals D1*a* and D2*a* of the second winding SL2*a* are coupled to two pins 217 of the first pin holder 216 disposed inside the first area AR1.

The order of the winding sections configured in the main body 212 can be changed. For example, the primary winding section ZN1, the secondary winding section ZN2, and the secondary winding section ZN3 are arranged in series starting from the first pin holder 216 to the second pin holder 218, i.e., the primary winding section ZN1 is arranged at a side of the secondary winding section ZN2, and the secondary winding section ZN3 is arranged at another side of the secondary winding section ZN2. The present disclosure is not limited thereto. Besides, the winding section of the third winding SL2*b* can be changed to a primary winding section (not shown in FIGs), so that the main body 212 of the bobbin 210 has two primary winding sections and one secondary winding section. Similarly, the number of the primary winding section and the secondary winding section can be changed. The present disclosure is not limited thereto.

In the following disclosure, a primary winding is taken as an example of the first winding and a secondary winding is taken as an example of the second winding and the third winding. When the electrical equipment wants to output at higher power, the secondary winding section can be laterally added in the main body 212, and the second winding is wound around the added secondary winding section, i.e., the secondary winding is laterally added, to increase Electro-Magnetic Energy Conversion and to achieve the needed current density outputted from the outlet terminal of the electronic device.

As shown in FIGS. 2A, 2C-2F, the main body 212 further has at least one partition plate BD3 configured in the common border between any adjacent winding sections, to separate the primary winding and the secondary winding and to meet safety requirements. As shown in FIG. 2C, the common border among the primary winding section ZN1 and the secondary winding sections ZN2, ZN3 of the main body 212 configures a partition plate BD3, to separate the first winding ML2 (the primary side), the second winding SL2*a* (the secondary side), and the third winding SL2*b* (the secondary side).

Figure 2G:
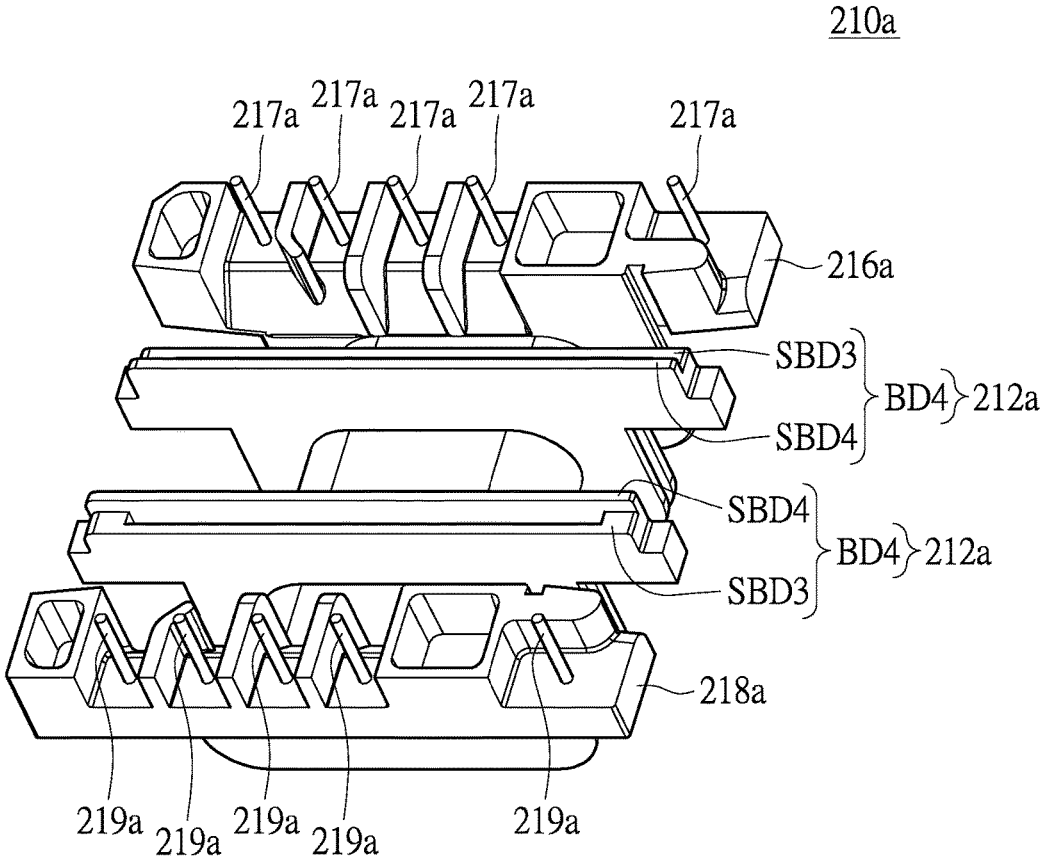
FIG. 2G shows a bottom-side view of a bobbin according to another exemplary embodiment of the present disclosure.

Next, please refer to FIG. 2G, which shows a bottom-side view of a bobbin according to another exemplary embodiment of the present disclosure. In the bobbin 210*a* shown in FIG. 2G, the partition plate BD4 of the main body 211A is different from the partition plate BD3 shown in FIGS. 2A, 2C-2F. The difference is that the partition plate BD4 has a first sub-partition plate SBD3 and a second sub-partition plate SBD4. The height of the first sub-partition plate SBD3 is higher than the height of the second sub-partition plate SBD4 and the first sub-partition plate SBD3 and the second sub-partition plate SBD4 are configured to each other, to form a ladder structure. This means that there is a drop height between the first sub-partition plate SBD3 and the second sub-partition plate SBD4. With respect to structures and connection relationships of the first pin holder 216*a*, the second pin holder 218*a*, the pins 217*a* and 219*a*, the first winding ML2, the second winding SL2*a*, and the third winding SL2*b* are the same as that of the first pin holder 216, the second pin holder 218, the pins 217 and 219, the first winding ML2, the second winding SL2*a*, and the third winding SL2*b* shown in FIG. 2C, so detailed description is omitted.

Therefore, there is a ladder structure formed between the first sub-partition plate SBD3 and the second sub-partition plate SBD4, so that the Creepage Distance between the first winding ML2, the second winding SL2*a*, and the third winding SL2*b* (i.e., the primary side and the secondary side) is increased. Accordingly, the bobbin 210*a* meets the higher safety requirement using the same thickness of the partition plate BD4. Besides, when the electrical equipment wants to output the higher power in the same layout area, it needs to decrease the power loss. At present, when electrical equipment has to operate in high altitude above 5,000 meters and simultaneously meet safety requirements, the distance between the partition plates needs to be increased, to achieve the official regulatory distance that must be kept between the primary and the secondary side. The aforementioned method may raise leakage inductance and then increase the power loss of the transformers, to increase the needed layout area. Therefore, under the ladder structure between the first sub-partition plate SBD3 and the second sub-partition plate SBD4, when the thickness of the partition plate BD2 of the bobbin 210*a* is decreased, the bobbin 210*a* can still meet the higher safety requirement for high-power electrical equipment configured in the high altitude above 5,000 meters.

In summary, the invention is to provide a magnetic component, which configures positions of the outlet terminals of the primary winding and the secondary winding, so that at least one outlet terminal of the primary winding and at least one outlet terminal of the secondary winding are positioned at a same side. Accordingly, the magnetic component can decrease the volume of the whole magnetic component without influencing conversion efficiency. Besides, when the electronic device with the magnetic component wants to output the higher power, the secondary winding can be laterally added in the magnetic component, to increase Electro-Magnetic Energy Conversion, so that the magnetic component does not suffer from the limitation of product process and height, and the output terminal of the electrical equipment can output the needed current density.

The above-mentioned descriptions represent merely the exemplary embodiment of the present disclosure, without any intention to limit the scope of the present disclosure thereto. Various equivalent changes, alterations or modifications based on the claims of present disclosure are all consequently viewed as being embraced by the scope of the present disclosure.

What is claimed is:

1. A magnetic component, comprising:

a bobbin, having a main body, a channel, and a pin holder, the main body having a primary winding section and a secondary winding section, the channel configured for penetrating the main body, and the pin holder configured for being extended from a side of the main body;

a magnetic core assembly, at least partially disposed in the channel; and a first winding and a second winding, respectively having two outlet terminals, the first winding configured for being wound around the primary winding section, and the second winding configured for being wound around the secondary winding section, wherein the secondary winding section extends to an area on the pin holder, the area is defined by lines extending from the outer boundary of the secondary winding section of the bobbin;

wherein two outlet terminals of the first winding and two outlet terminals of the second winding are configured in the pin holder;

wherein the pin holder has a plurality of pins, two outlet terminals of the first winding are coupled to two of the pins disposed outside the area, and two outlet terminals of the second winding are coupled to two of the pins disposed inside the area;

wherein the outer diameter of the primary winding section and the outer diameter of the secondary winding section are equivalent.

2. The magnetic component according to claim 1, wherein the primary winding section is configured in a side of the secondary winding section.

3. The magnetic component according to claim 1, further comprising a third winding, and the main body further comprising another primary winding section, wherein the third winding is wound around the another primary winding section and has two outlet terminals configured in the pin holder, and the another primary winding section is configured in a side of the primary winding section or a side of the secondary winding section.

4. The magnetic component according to claim 1, further comprising a third winding, and the main body further comprising another secondary winding section, wherein the third winding is wound around the another secondary winding section and has two outlet terminals configured in the pin holder, and the another secondary winding section is configured in a side of the primary winding section or a side of the secondary winding section.

5. The magnetic component according to claim 1, wherein the main body further comprises at least one partition plate configured in the common border between the primary winding section and the secondary winding section.

6. The magnetic component according to claim 5, wherein the partition plate has a first sub-partition plate and a second sub-partition plate assembled with each other, the height of the first sub-partition plate is higher than the height of the second sub-partition plate, to form a ladder structure.

7. A magnetic component, comprising:

a bobbin, having a main body, a channel, a first pin holder, and a second pin holder, the main body having a primary winding section, a secondary winding section, and another secondary winding section, the channel configured for penetrating the main body, the secondary winding section configured for being extended from a side of the primary winding section, and the another secondary winding section configured for being extended from another side of the primary winding section;

a magnetic core assembly, at least partially disposed in the channel; and a first winding and a second winding, respectively having two outlet terminals, the first winding configured for being wound around the primary winding section, and the second winding configured for being wound around the secondary winding section, wherein the secondary winding section extends to a first area on the first pin holder and the another secondary winding section extends to a second area on the second pin holder, the first area is defined by lines extending from the outer boundary of the secondary winding section, and the second area is defined by the lines extending from the outer boundary of the another secondary winding section;

wherein one of the two outlet terminals of the first winding is configured in the first pin holder, and the other of the two outlet terminals of the first winding is configured in the second pin holder;

wherein the two outlet terminals of the second winding are configured in the first pin holder;

wherein the first pin holder and the second pin holder have a plurality of pins respectively, one of the two outlet terminals of the first winding is coupled to one pin of the first pin holder disposed outside the first area, the other of the two outlet terminals of the first winding is coupled to one pin of the second pin holder disposed outside the second area, and two outlet terminals of the second winding are coupled to two pins of the first pin holder disposed inside the first area;

wherein the outer diameter of the primary winding section and the outer diameter of the secondary winding sections are equivalent.

8. The magnetic component according to claim 7, further comprising a third winding, and the main body further comprising another primary winding section, wherein the third winding is wound around the another primary winding section and has two outlet terminals configured in the second pin holder, and the another primary winding section is configured in a side of the primary winding section or a side of the secondary winding section.

9. The magnetic component according to claim 7, further comprising a third winding, wherein the third winding is wound around the another secondary winding section and has two outlet terminals configured in the second pin holder.

10. The magnetic component according to claim 8, wherein the main body further comprises a plurality of partition plates configured in the common border among the primary winding section, the secondary winding section, and the another primary winding section.

11. The magnetic component according to claim 9, wherein the main body further comprises a plurality of partition plates configured in the common border among the primary winding section, the secondary winding section, and the another secondary winding section.

12. The magnetic component according to claim 10, wherein the partition plates have a first sub-partition plate and a second sub-partition plate assembled with each other, the height of the first sub-partition plate is higher than the height of the second sub-partition plate, to form a ladder structure.

13. The magnetic component according to claim 11, wherein the partition plates have a first sub-partition plate and a second sub-partition plate assembled with each other, the height of the first sub-partition plate is higher than the height of the second sub-partition plate, to form a ladder structure.

14. A magnetic component, comprising:

a bobbin, having a main body, a channel, a first pin holder, and a second pin holder, the main body having a primary winding section and a secondary winding section, the channel configured for penetrating the main body, the first pin holder configured for being extended from a side of the main body, and the second pin holder configured for being extended from another side of the main body;

a magnetic core assembly, at least partially disposed in the channel; and a first winding and a second winding, respectively having two outlet terminals, the first winding configured for being wound around the primary winding section, and the second winding configured for being wound around the secondary winding section, wherein the secondary winding section extends to a first area on the first pin holder, the first area is defined by lines extending from the outer boundary of the secondary winding section of the bobbin;

wherein the two outlet terminals of the first winding are configured in the first pin holder;

wherein the two outlet terminals of the second winding are configured in the first pin holder;

wherein the first pin holder has a plurality of pins, the two outlet terminals of the first winding are coupled to two pins of the first pin holder disposed outside the first area, and two outlet terminals of the second winding are coupled to two pins of the first pin holder disposed inside the first area;

wherein the outer diameter of the primary winding section and the outer diameter of the secondary winding section are equivalent.

15. The magnetic component according to claim 14, further comprising a third winding, and the main body further comprising another primary winding section, wherein the third winding is wound around the another primary winding section and has two outlet terminals configured in the second pin holder, and the another primary winding section is configured in a side of the primary winding section or a side of the secondary winding section.

16. The magnetic component according to claim 14, further comprising a third winding, and the main body further comprising another secondary winding section, wherein the third winding is wound around the another secondary winding section and has two outlet terminals configured in the second pin holder, and the another secondary winding section is configured in a side of the primary winding section or a side of the secondary winding section.

* * * * *